US008988335B2

(12) United States Patent
Jung et al.

(10) Patent No.: US 8,988,335 B2
(45) Date of Patent: Mar. 24, 2015

(54) DISPLAY DEVICE AND DRIVING METHOD THEREOF

(75) Inventors: Youn Jin Jung, Daejeon (KR); Jae-Won Jeong, Seoul (KR); Kwan-Young Oh, Seoul (KR); Po-Yun Park, Seoul (KR); Jung Hwan Cho, Asan-si (KR)

(73) Assignee: Samsung Display Co., Ltd. (KR)

( * ) Notice: Subject to any disclaimer, the term of this patent is extended or adjusted under 35 U.S.C. 154(b) by 282 days.

(21) Appl. No.: 13/427,256

(22) Filed: Mar. 22, 2012

(65) Prior Publication Data

US 2013/0135283 A1 May 30, 2013

(30) Foreign Application Priority Data

Nov. 24, 2011 (KR) ..... 10-2011-0123576

(51) Int. Cl.
*G09G 3/36* (2006.01)

(52) U.S. Cl.
CPC ..... *G09G 3/3614* (2013.01); *G09G 3/3648* (2013.01); *G09G 2320/0247* (2013.01)
USPC ..... 345/98

(58) Field of Classification Search
CPC ..... G06F 3/038
USPC ..... 345/204, 212, 618, 98
See application file for complete search history.

(56) References Cited

U.S. PATENT DOCUMENTS

| | | | | |
|---|---|---|---|---|
| 6,417,828 | B1 | 7/2002 | Sato et al. | |
| 7,307,613 | B2 * | 12/2007 | Teshirogi et al. | 345/98 |
| 2005/0219189 | A1 * | 10/2005 | Fukuo | 345/96 |
| 2009/0195529 | A1 | 8/2009 | Nam et al. | |
| 2010/0149151 | A1 | 6/2010 | Nam et al. | |
| 2010/0214315 | A1 | 8/2010 | Nguyen et al. | |
| 2010/0214316 | A1 * | 8/2010 | Kim et al. | 345/618 |
| 2011/0037760 | A1 | 2/2011 | Kim et al. | |
| 2013/0249880 | A1 * | 9/2013 | Chen et al. | 345/211 |

FOREIGN PATENT DOCUMENTS

| | | |
|---|---|---|
| JP | 2008-286869 | 11/2008 |
| JP | 2009-092906 | 4/2009 |
| KR | 10-2008-0048246 | 6/2008 |
| KR | 10-2009-0061466 | 6/2009 |
| KR | 10-2010-0070205 | 6/2010 |
| KR | 10-2010-0095180 | 8/2010 |
| KR | 10-2010-0122841 | 11/2010 |
| KR | 10-2011-0010426 | 2/2011 |
| KR | 10-2011-0011309 | 2/2011 |
| KR | 10-2011-0018722 | 2/2011 |

* cited by examiner

*Primary Examiner* — Pegeman Karimi
(74) *Attorney, Agent, or Firm* — Cantor Colburn LLP

(57) ABSTRACT

A display device includes a display panel including a plurality of pixels, a data driver which transmits data voltages to the plurality of pixels, and a signal controller which receives an input image signal and an input control signal to control the data driver, where the signal controller calculates a ratio of a first type of pattern in a image based on the input image signal, generates a polarity signal based on the ratio of the first type of pattern, and transmits the polarity signal to the data driver.

19 Claims, 9 Drawing Sheets

FIG. 4

| | Modified inversion mode | Reference inversion mode |
|---|---|---|
| Combination 1 | Ratio of invulnerable pattern | Ratio of invulnerable pattern |
| Combination 2 | Ratio of vulnerable pattern | Ratio of invulnerable pattern |
| Combination 3 | Ratio of invulnerable pattern | Ratio of vulnerable pattern |

DISPLAY DEVICE AND DRIVING METHOD THEREOF

This application claims priority to Korean Patent Application No. 10-2011-0123576, filed on Nov. 24, 2011, and all the benefits accruing therefrom under 35 U.S.C. §119, the content of which in its entirety is herein incorporated by reference.

BACKGROUND OF THE INVENTION (a) Field of the Invention

Exemplary embodiments of the invention relate to a display device and a driving method of the display device.

(b) Description of the Related Art

In general, a display device may include a plurality of pixels including switching elements and pixel electrodes connected thereto, a display panel including a plurality of signal lines such as gate lines and data lines for controlling the switching elements and applying voltages to the pixel electrodes, a gray voltage generator for generating reference gray voltages, a data driver that generates a plurality of gray voltages using the reference gray voltages and applies the gray voltage corresponding to an input image signal based on the generated gray voltages to a corresponding data line of the signal lines as a data signal, and a gate driver that transmits gate signals to the gate lines.

The reference gray voltages may include a set of voltages having positive values with respect to a common voltage and a set of voltages having negative values with respect to the common voltage. The data driver may divide the reference gray voltages including the set of voltages having positive values and the set of voltages having negative values to generate gray voltages for all gray levels, and select a data signal based on the generated gray voltages. A polarity of the data voltage with respect to the common voltage may be inverted every frame, and a polarity of the data voltage flowing in one data line may be changed based on an inversion signal even in one frame, or a polarity of the data voltage flowing in several data lines may not be changed. A driving mode, in which the polarity of the data voltage is changed for each predetermined frame, for each predetermined pixel, or for each pixel, is called a polarity inversion mode or an inversion mode.

When the inversion mode is performed, deterioration of the image quality may be prevented, but when an image having specific pattern, for example, when most pixels display a gray level corresponding to white have the same polarity, deterioration of the image quality such as a screen flickering may occur.

BRIEF SUMMARY OF THE INVENTION

Exemplary embodiments of the invention relate to a display device with improved quality of an image in a specific pattern.

Exemplary embodiments of the invention relate to a display device including a signal controller using simplified algorithms or circuits.

An exemplary embodiment of a display device includes: a display panel including a plurality of pixels; a data driver which transmits data voltages to the plurality of pixels; and a signal controller which receives an input image signal and an input control signal to control the data driver, where the signal controller calculates a ratio of a first type of pattern in a image based on the input image signal, generates a polarity signal based on the ratio of the first type of pattern, and transmits the polarity signal to the data driver.

In an exemplary embodiment, the signal controller may include an inversion mode identifying unit which identifies whether a previous inversion mode is a reference inversion mode or a modified inversion mode, an pattern ratio detecting unit which detects a ratio of the first type of pattern for the reference inversion mode based on the input image signal, and an inversion mode determining unit which determines an inversion mode of a current frame based on the ratio of the first type of pattern.

In an exemplary embodiment, the inversion mode determining unit may use the ratio of the first type of pattern when the previous inversion mode is the reference inversion mode or when the previous inversion mode is the modified inversion mode.

In an exemplary embodiment, the inversion mode determining unit may determine the inversion mode of the current frame as the modified inversion mode, when the ratio of the first type of pattern is less than a first reference value, the inversion mode determining unit may determine the inversion mode of the current frame as the reference inversion mode, when the ratio of the first type of pattern is greater than or equal to the first reference value and the previous inversion mode is the reference inversion mode, the inversion mode determining unit may determine the inversion mode of the current frame as the reference inversion mode, when the ratio of the first type of pattern is greater than a second reference value, and the inversion mode determining unit may determine the inversion mode of the current frame as the modified inversion mode, when the ratio of the first type of pattern is less than or equal to the second reference value and the previous inversion mode is the modified inversion mode.

In an exemplary embodiment, the first reference value may be less than the second reference value.

In an exemplary embodiment, the pattern ratio detecting unit may detect a ratio of a second type of pattern in the image for the reference inversion mode based on the input image signal, the inversion mode determining unit may determine the inversion mode of the current frame as the modified inversion mode, when the ratio of the second type of pattern is greater than a third reference value, the inversion mode determining unit may determine the inversion mode of the current frame as the reference inversion mode, when the ratio of the second type of pattern is less than or equal to the third reference value and the previous inversion mode is the reference inversion mode, the inversion mode determining unit may determine the inversion mode of the current frame as the reference inversion mode, when the ratio of the first type of pattern is greater than a second reference value, and the inversion mode determining unit may determine the inversion mode of the current frame as the modified inversion mode, when the ratio of the first type of pattern is less than or equal to the second reference value and the previous inversion mode is the modified inversion mode.

In an exemplary embodiment, the pattern ratio detecting unit may detect a ratio of a second type of pattern in the image for the reference inversion mode based on the input image signal, the inversion mode determining unit may determine the inversion mode of the current frame as the modified inversion mode, when the ratio of the first type of pattern is less than a first reference value, the inversion mode determining unit may determine the inversion mode of the current frame as the reference inversion mode, when the ratio of the first type of pattern is greater than or equal to the first reference value and the previous inversion mode is the reference inversion mode, the inversion mode determining unit may determine the inversion mode of the current frame as the reference inversion mode, when the ratio of the second type of pattern is less than a fourth reference value, and the inversion mode determining unit may determine the inversion mode of the current frame as the modified inversion mode, when the ratio of the second type of pattern is greater than or equal to the fourth reference value and the previous inversion mode is the modified inversion mode.

In an exemplary embodiment, the ratio of the first type of pattern may be represented by one of percentage, the number of pixels and the number of pixel blocks, each of which includes at least one of at least two pixels, at least one pixel row and at least one pixel column.

In an exemplary embodiment, the ratio of the first type of pattern may be calculated by determining whether a unit image of the image based on the input image signal corresponds to the second type of pattern, and the unit image may be an image displayed by any one of a pixel and a pixel block, where the pixel block include one of at least two pixels, at least one pixel row, at least one pixel column and a combination thereof.

An exemplary embodiment of a driving method of a display device includes: calculating a ratio of a first type of pattern in an image based on an input image signal; and determining an inversion mode of a current frame based on the ratio of the first type of pattern, where the display device includes a display panel including a plurality of pixels, a data driver, and a signal controller which receives the input image signal and an input control signal to control the data driver.

In an exemplary embodiment, the driving method of a display device may further include identifying whether a previous inversion mode is a reference inversion mode or a modified inversion mode.

In an exemplary embodiment, the ratio of the first type of pattern is a ratio of the first type of pattern in the image displayed in the reference inversion mode.

In an exemplary embodiment, the calculating the ratio of the first type of pattern in the image may include determining whether a unit image of the image based on the input image signal corresponds to a second type of pattern, and the unit image is an image display by one of a pixel and a pixel block, where the pixel block includes at least two pixels, at least one pixel row, at least one pixel column or a combination thereof.

In an exemplary embodiment, the determining the inversion mode of the current frame may include: determining the inversion mode of the current frame as the modified inversion mode, when the ratio of the first type of pattern is less than a first reference value; determining the inversion mode of the current frame as the reference inversion mode, when the ratio of the first type of pattern is greater than or equal to the first reference value and the previous inversion mode is the reference inversion mode; determining the inversion mode of the current frame as the reference inversion mode, when the ratio of the first type of pattern is greater than a second reference value; and determining the inversion mode of the current frame as the modified inversion mode, when the ratio of the first type of pattern is less than or equal to the second reference value and the previous inversion mode is the modified inversion mode.

In an exemplary embodiment, the first reference value may be less than the second reference value.

In an exemplary embodiment, the calculating the ratio of the first type of pattern in the image may further include detecting a ratio of a second type of pattern in the image for the reference inversion mode based on the input image signal.

In an exemplary embodiment, the determining the inversion mode of the current frame may include: determining the inversion mode of the current frame as the modified inversion mode, when the ratio of the second type of pattern is greater than a third reference value; determining the inversion mode of the current frame as the reference inversion mode, when the ratio of the second type of pattern is less than or equal to the third reference value and the previous inversion mode is the reference inversion mode; determining the inversion mode of the current frame as the reference inversion mode, when the ratio of the first type of pattern is greater than a second reference value; and determining the inversion mode of the current frame as the modified inversion mode, when the ratio of the first type of pattern is less than or equal to the second reference value and the previous inversion mode is the modified inversion mode.

In an exemplary embodiment, the determining the inversion mode of the current frame may include: determining the inversion mode of the current frame as the modified inversion mode, when the ratio of the first type of pattern is less than a first reference value; determining the inversion mode of the current frame as the reference inversion mode, when the ratio of the first type of pattern is greater than or equal to the first reference value and the previous inversion mode is the reference inversion mode; determining the inversion mode of the current frame as the reference inversion mode, when the ratio of the second type of pattern is less than a fourth reference value; and determining the inversion mode of the current frame as the modified inversion mode, when the ratio of the second type of pattern is greater than or equal to the fourth reference value and the previous inversion mode is the modified inversion mode.

In an exemplary embodiment, the ratio of the first type of pattern may be represented in a unit, which is one of percentage, a number of pixels and a number of pixel blocks, where each of the pixel blocks includes at least two pixels, at least one pixel row or at least one pixel column.

According to the exemplary embodiments of the invention, algorithms or circuits of a signal controller is substantially simplified and image quality of an image of a specific pattern is substantially improved.

BRIEF DESCRIPTION OF THE DRAWINGS

The above and other features of the invention will become more apparent by describing in further detail exemplary embodiments thereof with reference to the accompanying drawings, in which:

FIG. 4 is a table showing an exemplary embodiment of a combination of patterns used in an operation of determining an inversion mode in a display device according to the invention.

DETAILED DESCRIPTION OF THE INVENTION

Figure 1:
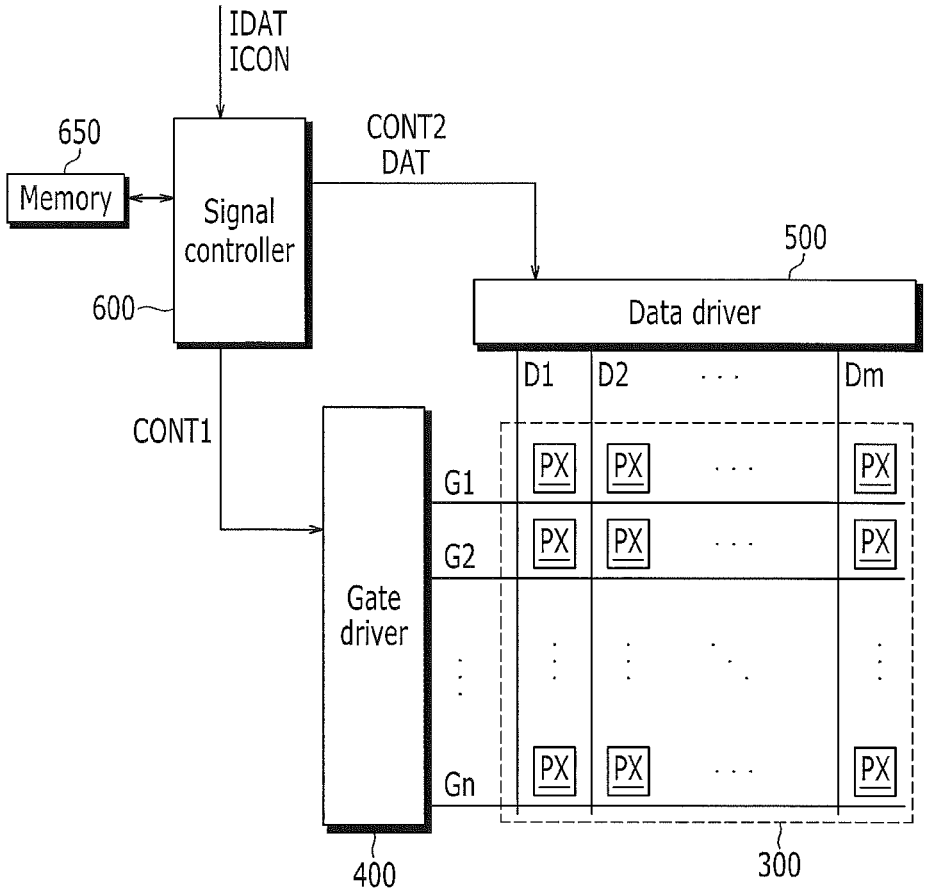
FIG. 1 is a block diagram showing an exemplary embodiment of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

First, an exemplary embodiment of a display device according to the invention will be described with reference to FIGS. 1 and 2.

FIG. 1 is a block diagram showing an exemplary embodiment of a display device according to the invention.

Referring to FIG. 1, an exemplary embodiment of the display device includes a display panel 300, a gate driver 400, a data driver 500, a signal controller 600 that controls the gate driver 400 and the data driver 500, and a memory 650.

The display panel 300 includes a plurality of signal lines G1 to Gn and D1 to Dm and a plurality of pixels PX connected thereto and arranged in a substantially matrix form. The signal lines G1 to Gn and D1 to Dm include a plurality of gate lines, e.g., first to n-th gate lines G1 to Gn for transmitting gate signals and a plurality of data lines, e.g., first to m-th data lines D1 to Dm for transmitting data voltages. Here, 'n' and 'm' are natural numbers. Each of the pixels PX may include a switching element (not shown) connected to corresponding signal lines, e.g., an i-th gate line Gi and a j-th data line Dj ('l' is a natural number less than or equal to n, and T is a natural number less than or equal to m), a pixel electrode (not shown) connected to the switching element, for example, but not being limited thereto. In an exemplary embodiment, of the display panel 300 may be a liquid crystal display, and the display panel 300 includes two display panels opposite to each other and a liquid crystal layer (not shown) interposed therebetween. In such an embodiment, the two display panels may include pixel electrodes connected with the switching elements and opposing electrodes that receive a common voltage.

The signal controller 600 receives signals such as an input image signal IDAT and an input control signal ICON that controls a display of the input image signal IDAT, for example, from an outside thereof to control the gate driver 400 and the data driver 500 based on the signals. The input image signal IDAT has luminance information of each of the pixels PX, and the luminance information may have a predetermined number of values, for example, $2^l$ ('l' is a natural number) grayscale values. In an exemplary embodiment, the input control signal ICON may include synchronization signals such as a vertical synchronization signal, a horizontal synchronizing signal, a main clock and a data enable signal, for example.

The signal controller 600 processes the input image signal IDAT to be corresponding to operating conditions of the display panel 300 and the data driver 500 based on the input image signal IDAT and the input control signal ICON. The signal controller 600 generates control signals, such as a gate control signal CONT1 and a data control signal CONT2, for example. In an exemplary embodiment, the signal controller 600 transmits the gate control signal CONT1 to the gate driver 400 and transmits the data control signal CONT2 and an output image signal DAT, which is generated by processing the input image signal IDAT, to the data driver 500.

In an exemplary embodiment, the gate control signal CONT1 may include a scanning start signal for instructing a scanning start, at least one gate clock signal for controlling an output period of the gate-on voltage Von, and at least one output enable signal for limiting a duration time of the gate-on voltage Von, for example.

In an exemplary embodiment, the data control signal CONT2 may include a horizontal synchronization start signal for notifying a transmission start of the output image signal DAT to a pixel row, a load signal for instructing the application of the data signal to the display panel 300, a data clock signal and a data enable signal, for example. The data control signal CONT2 may further include a polarity signal for controlling the polarity of a voltage of the data signal with respect to a common voltage (hereinafter, referred to as a "polarity of the data signal"). In an exemplary embodiment, an inversion driving mode of the display device may be determined based on the polarity signal.

In an exemplary embodiment of the display device, the inversion driving mode includes a reference inversion mode and at least one modified inversion mode. In such an embodiment, the modified inversion mode may be an inversion mode different from the reference inversion mode. In one exemplary embodiment, for example, the reference inversion mode is 1×1, 2×1 or 1×2 dot inversion modes, and the modified inversion mode may be a mode different from the reference inversion mode such as 2×2, 3×3, 4×4 or 5×5 dot inversion modes, for example, but not being limited thereto.

The data driver 500 is connected with the data lines D1 to Dm of the display panel 300. The data driver 500 receives the output image signal DAT for the pixels PX in one pixel row from the signal controller 600, and selects a gray voltage corresponding to the output image signal DAT based on the data control signal CONT2 to convert the output image signal DAT, which is a digital format, into analog data voltage. In such an embodiment, the data driver 500 applies the converted analog data voltage to the corresponding data line Dj of the data lines D1 to Dm. In such an embodiment, the converted analog data voltage may have a positive polarity or a negative polarity based on the polarity signal.

The gate driver 400 is connected to the gate lines G1 to Gn of the display panel 300. The gate driver 400 applies the gate signals, including gate-on voltage Von for turning on the switching element of the pixel PX and gate-off voltage Voff for turning off the switching element of the pixel PX, to the gate lines G1 to Gn based on the gate control signal CONT1 from the signal controller 600.

The memory 650 may store information regarding an operation of the signal controller 600 such as gamma data, for example, but not being limited thereto.

Hereinafter, an exemplary embodiment of the signal controller 600 shown in FIG. 1 will be described in greater detail with reference to FIG. 2.

Figure 2:
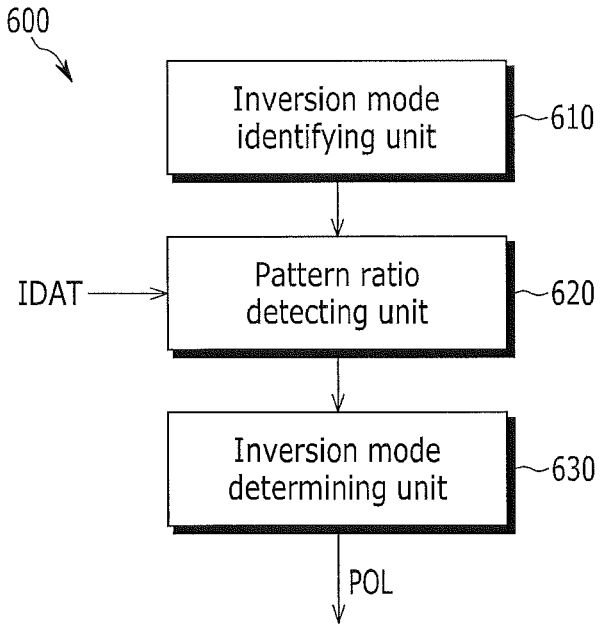
FIG. 2 is a block diagram showing an exemplary embodiment of a signal controller of a display device according to the invention.

FIG. 2 is a block diagram showing an exemplary embodiment of a signal controller of a display device according to the invention.

Referring to FIG. 2, an exemplary embodiment of the signal controller 600 of the display device includes an inversion mode identifying unit 610, a pattern ratio detecting unit 620 and an inversion mode determining unit 630.

In an exemplary embodiment, the inversion mode identifying unit 610 identifies the type of a previous inversion mode or the type of a predetermined inversion mode to transmit the result to the pattern ratio detecting unit 620. The inversion mode identifying unit 610 may identify a previous inversion mode or a predetermined inversion mode (collectively referred to as a previous inversion mode) based on the input control signal ICON or the polarity signal POL of the data control signal CONT2, for example, from the outside. The identified previous inversion mode may be one of the reference inversion mode and at least one modified inversion mode. In an exemplary embodiment, when the driving of the display device initially starts, the previous inversion mode may be the reference inversion mode.

In an exemplary embodiment, the pattern ratio detecting unit 620 detects a ratio of a first type of pattern with respect to the reference inversion mode based on the input image signal IDAT for at least one frame. In such an embodiment, the ratio of a second type of pattern may also be detected. Herein, the first type of pattern is a pattern different from the second type of pattern, and the second type of pattern may be one of various predetermined types of pattern, the quality of which is deteriorated when displayed in the reference inversion mode. Hereinafter, the first type of pattern will be referred to as an invulnerable pattern, and the second type of pattern will be referred to as a vulnerable pattern. The vulnerable pattern may vary based on a structure of the display device and the type of the reference inversion mode. In an exemplary embodiment, the vulnerable pattern may include a pattern, in which black and white grays are displayed and substantial portion of the pixels PX displaying white in the reference inversion mode have the same polarity. In an exemplary embodiment, the memory 650 may store various first types of pattern and second types of pattern.

In an exemplary embodiment, the ratio of the invulnerable pattern may be a ratio of the invulnerable pattern with respect to the entire screen during one frame. However, the ratio is not limited thereto and may be represented by various units such as the number of pixels PX and the number of pixel blocks, for example. Each of the pixels block may include at least two pixels PX, at least one pixel row or at least one pixel column, for example. In an alternative exemplary embodiment, the ratio may be calculated during two or more frames, and the ratio of the invulnerable pattern may be an average or intermediate value of the ratio of the invulnerable pattern to each frame.

Hereinafter, an exemplary embodiment of a method of detecting a ratio of the invulnerable pattern or a ratio of the vulnerable pattern together with the ratio of the invulnerable pattern in the pattern ratio detecting unit 620 will be described with reference to FIGS. 2 and 3.

Figure 3:
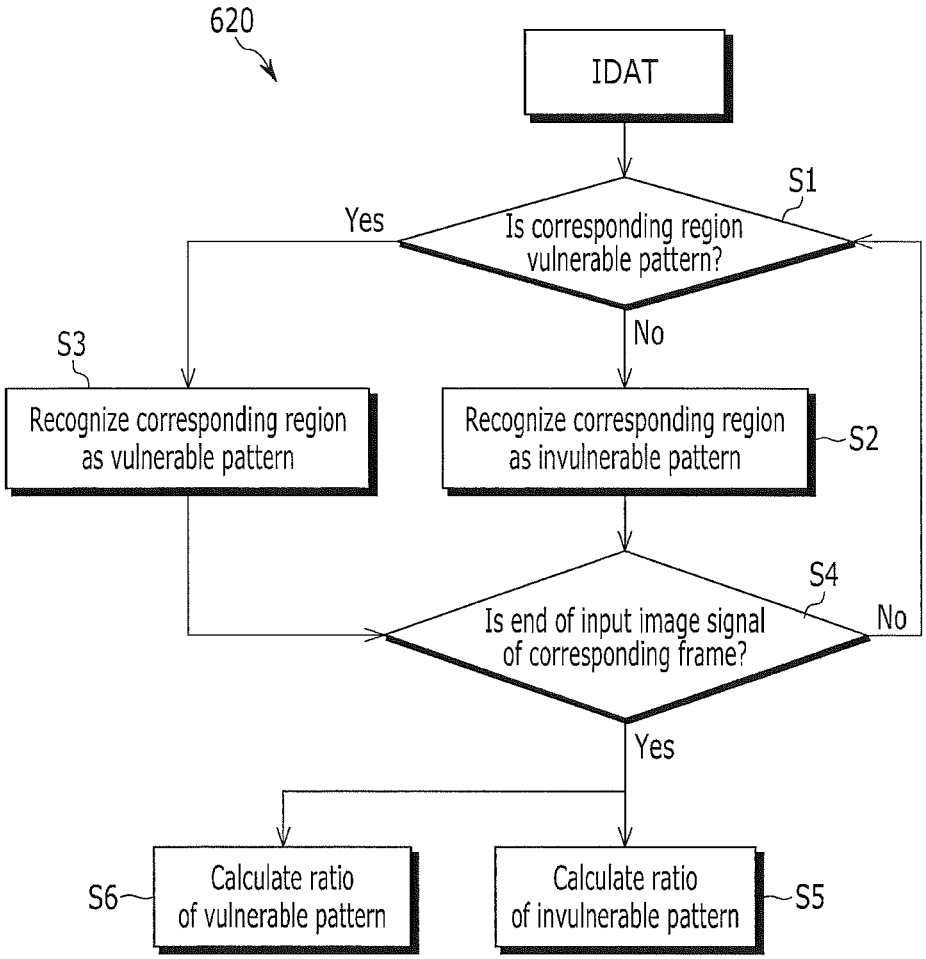
FIG. 3 is a flowchart showing an operation of an exemplary embodiment of a pattern ratio detecting unit of a display device according to the invention.

FIG. 3 is a flowchart showing an operation of an exemplary embodiment of the pattern ratio detecting unit 620 of the display device according to the invention.

Referring to FIGS. 2 and 3, the pattern ratio detecting unit 620 determines whether a corresponding region of the input image signal IDAT, which is in a predetermined unit (referred to as an "invulnerable pattern detecting unit"), is the vulnerable pattern (S1). In such an embodiment, the predetermined unit or the invulnerable pattern detecting unit may be, for example, pixels PX, pixel blocks, each of which includes at least two pixels PX, at least one pixel row or at least one pixel column, or a combination thereof. In such an embodiment, the detected ratio of the invulnerable pattern or the vulnerable pattern may be represented by a percentage (%) or may also be represented by a number of the predetermined units. The pattern ratio detecting unit 620 determines whether the corresponding region of the input image signal IDAT, which is corresponding to the predetermined unit or the invulnerable pattern detecting unit, is substantially identical to one of the various vulnerable patterns pre-stored in the memory 650.

When the corresponding region does not correspond to the vulnerable pattern (NO), the corresponding region is recognized as the invulnerable pattern (S2). When the corresponding region corresponds to the vulnerable pattern (YES), the corresponding region is recognized as the vulnerable pattern (S3). The invulnerable pattern detecting unit 620 determined whether the corresponding region of the input image signal IDAT is an end region of the input image signal IDAT of a corresponding frame (S4), and if so, a ratio of the invulnerable pattern to the corresponding frame is calculated and stored (S5). In such an embodiment, a ratio of the vulnerable pattern may also be calculated and stored (S6). The sum of the ratio of the vulnerable pattern and the ratio of the invulnerable pattern may be 100% when a unit of the ratio is percentage. When the corresponding region is not the end of the input image signal IDAT of the corresponding frame, the process returns to the start point, and the invulnerable pattern detecting unit 620 determines whether a next corresponding region of the input image signal IDAT is the vulnerable pattern (S1) such that the same process described above is repeated.

The method of detecting the invulnerable pattern is not limited to the embodiment shown in FIG. 3, but the ratio of the invulnerable pattern may be detected by various methods.

Referring back to FIG. 2, the inversion mode determining unit 630 determines an inversion mode to be performed during the corresponding frame based on the detected result of the pattern ratio detecting unit 620, that is, the ratio of the invulnerable pattern or the ratio of the vulnerable pattern, and generates the polarity signal POL based on the determined inversion mode.

In such an embodiment, a combination of a type of the pattern used for determining the inversion mode to be performed during the corresponding frame when the previous inversion mode identified in the inversion mode identifying unit 610 is the reference inversion mode and a type of the pattern used for determining the inversion mode to be performed for the corresponding frame when the previous inversion mode is the modified inversion mode may vary. Exemplary embodiment of various combinations described above will be described with reference to FIG. 4.

FIG. 4 is a table showing an exemplary embodiment of a combination of patterns used in an operation of determining an inversion mode in a display device according to the invention.

Referring to FIG. 4, in an exemplary embodiment, the ratio of the invulnerable pattern may be used to determine whether the inversion mode returns to the reference inversion mode when the previous inversion mode is the modified inversion mode or to determined whether the inversion mode enters the modified inversion mode when the previous inversion mode is the reference inversion mode. In one exemplary embodiment, for example, the ratio of the invulnerable pattern may be used to determined whether the inversion mode returns to the reference inversion mode when the previous inversion mode is the modified inversion mode, and the ratio of the invulnerable pattern may be used to determine whether the inversion mode enters the modified inversion mode when the previous inversion mode is the reference inversion mode (combination 1).

In an alternative exemplary embodiment, the ratio of the vulnerable pattern may be used to determine whether the inversion mode returns to the reference inversion mode when the previous inversion mode is the modified inversion mode may use, and the ratio of the invulnerable pattern may be used to determine whether the inversion mode enters the modified inversion mode when the previous inversion mode is the reference inversion mode (combination 2).

In another alternative exemplary embodiment, the ratio of the invulnerable pattern may be used to determine whether the inversion mode returns to the reference inversion mode when the previous inversion mode, and the ratio of the vulnerable pattern may be used to determine whether the inversion mode enters the modified inversion mode when the previous inversion mode is the reference inversion mode (combination 3).

The ratio of the invulnerable pattern may be used at least once in each of all the combinations.

Hereinafter, an exemplary embodiment of a method of determining an inversion mode to be performed for the corresponding frame in the signal controller 600 according to the invention based on the various combinations shown in FIG. 4 will be described with reference to FIGS. 5, 6 and 7 together with the aforementioned drawings.

Figure 5:
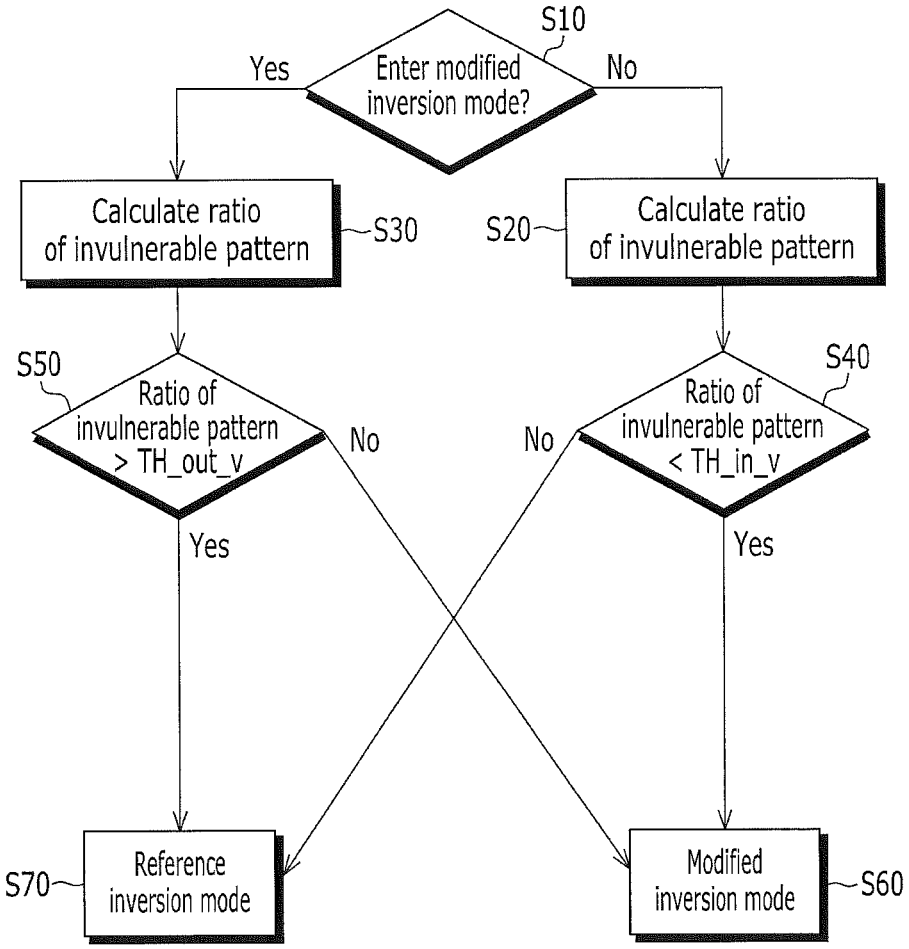
FIGS. 5, 6 and 7 are flowcharts showing exemplary embodiments of an operation of determining an inversion mode in a signal controller of a display device according to the invention.
Figure 6:
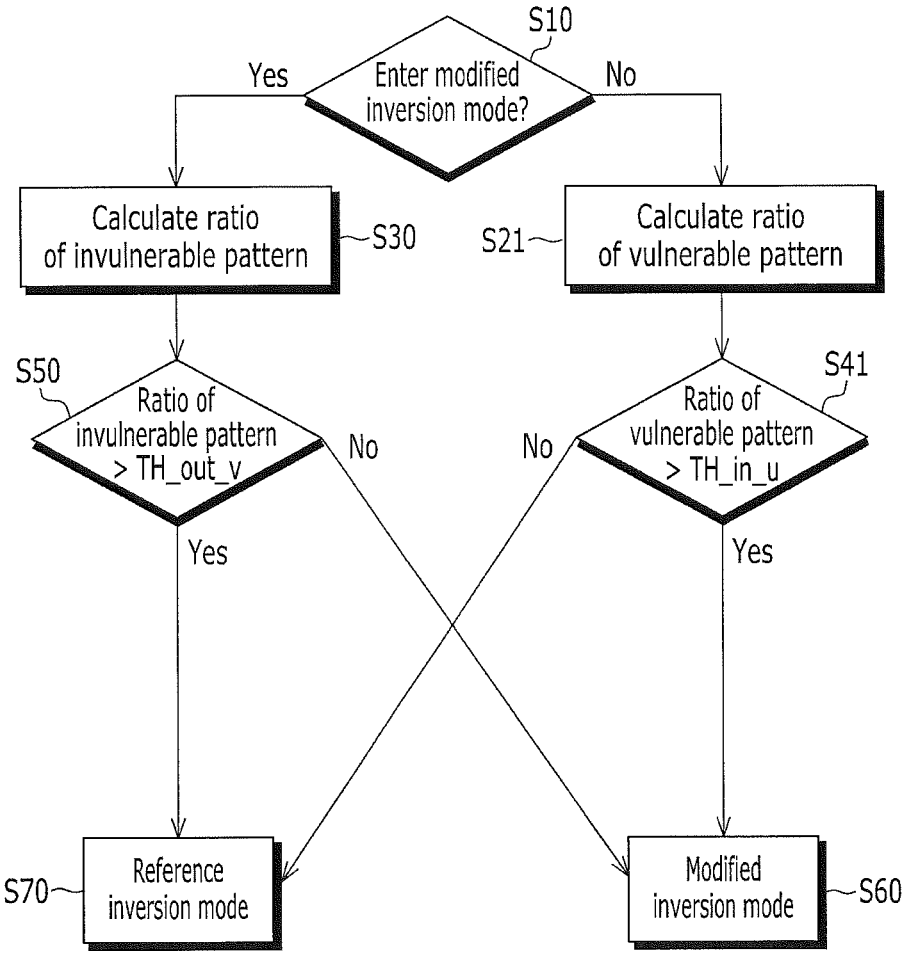
Figure 7:
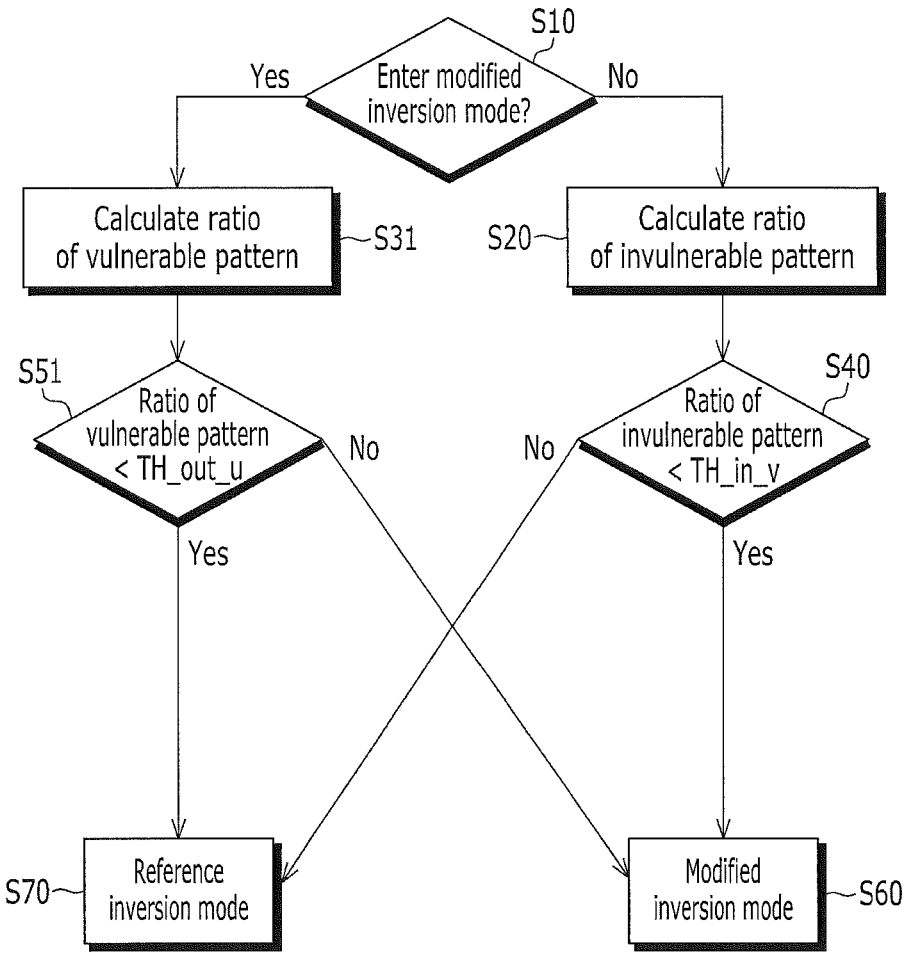

FIGS. 5, 6 and 7 are flowcharts showing exemplary embodiments of a method of determining an inversion mode in a signal controller of a display device according to the invention.

First, referring to FIG. 5, an exemplary embodiment of an operation of the signal controller 600 is performed based on the combination 1 of the combinations shown in FIG. 4.

In such an embodiment, as described above, the inversion mode identifying unit 610 of the signal controller 600 identifies the inversion mode type of the previous inversion mode, e.g., determines whether the previous inversion mode is the reference inversion mode or at least one modified inversion mode (S10).

In an exemplary embodiment, when the inversion mode type of the previous inversion mode (S10) is not the modified inversion mode (NO), that is, when the previous inversion mode is the reference inversion mode, the pattern ratio detecting unit 620 calculates the ratio of the invulnerable pattern as described above (S20). In an alternative exemplary embodiment, a sequence between identifying the previous inversion mode (S10) and calculating the ratio of the invulnerable pattern (S20) may be changed.

In an exemplary embodiment, the inversion mode determining unit 630 compares the ratio of the invulnerable pattern with a first reference value TH_in_v (S40). In such an embodiment, since the ratio of the vulnerable pattern is relatively high when the ratio of the invulnerable pattern is less than the first reference value TH_in_v (YES), the inversion mode determining unit 630 selects one of at least one modified inversion mode beyond the reference inversion mode such that the selected modified inversion mode is determined as the inversion mode of the corresponding frame (S60). In such an embodiment, since the ratio of the invulnerable pattern is relatively high when the ratio of the invulnerable pattern is great than or equal to the first reference value TH_in_v (NO), the inversion mode determining unit 630 maintains the reference inversion mode such that the reference inversion mode is determined as the inversion mode of the corresponding frame (S70).

When the inversion mode identified in the identifying of the previous inversion mode (S10) is the modified inversion mode (YES), that is, when the previous inversion mode is determined to be the modified inversion mode in advance, the pattern ratio detecting unit 620 calculates the ratio of the invulnerable pattern as described above (S30). In an alternative exemplary embodiment, the sequence between the identifying the previous inversion mode (S10) and the calculating the ratio of the invulnerable pattern (S30) may be changed.

In an exemplary embodiment, the inversion mode determining unit 630 compares the ratio of the invulnerable pattern with a second reference value TH_out_v (S50). In such an embodiment, when the ratio of the invulnerable pattern is greater than the second reference value TH_out_v (YES), the inversion mode determining unit 630 maintains the reference inversion mode such that the reference inversion mode is determined as the inversion mode of the corresponding frame (S70). In such an embodiment, when the ratio of the invulnerable pattern is less than or equal to the second reference value TH_out_v (NO), the inversion mode determining unit 630 selects one of at least one modified inversion mode such that the selected modified inversion mode is determined as the inversion mode of the corresponding frame (S60).

In an exemplary embodiment, as described above, the polarity signal POL is generated based on the inversion mode determined in the inversion mode determining unit 630 in the data driver 500, and the polarity of the data voltage is determined based on the polarity signal POL such that the inversion driving mode of the display device of the corresponding frame is determined based on the polarity signal POL.

In an alternative exemplary embodiment, as shown in FIG. 5, the first reference value TH_in_v and the second reference value TH_out_v may be expressed in a unit corresponding to the unit on the ratio of the invulnerable pattern. In one exemplary embodiment, for example, the first reference value TH_in_v and the second reference value TH_out_v may be represented by percentage as a ratio of the invulnerable pattern to the entire screen, but not being limited thereto. In an alternative exemplary embodiment, the first reference value TH_in_v and the second reference value TH_out_v may be represented by various units such as the number of pixels PX, the number of pixel blocks, each of which includes at least two pixels PX, at least one pixel row, or at least one pixel column, for example.

In such an embodiment, as shown in FIG. 5, the first reference value TH_in_v and the second reference value TH_out_v may be different from each other. In an exemplary embodiment, for example, the first reference value TH_in_v may be less than the second reference value TH_out_v. In such an embodiment, an effect from a frequent luminance change of the image is substantially reduced such that a frequency of entry into or escape from the modified inversion mode may be effectively prevented from being substantially high, and a deterioration of image quality due to the frequent luminance change may be prevented.

Referring to FIG. 6, another alternative exemplary embodiment of an operation of the signal controller 600 is performed based on the combination 3 of the combinations shown in FIG. 4. The same or like elements shown in FIG. 6 have been labeled with the same reference characters as used above to describe the exemplary embodiments of the operation of the signal controller shown in FIG. 5, and any repetitive detailed description thereof will hereinafter be omitted or simplified.

In an exemplary embodiment, when the inversion mode identified as the previous inversion mode (S10) is not the modified inversion mode (NO), that is, when the previous inversion mode is the reference inversion mode, the pattern ratio detecting unit 620 calculates a ratio of the vulnerable pattern (S21). In an alternative exemplary embodiment, the sequence between the identifying the previous inversion mode (S10) and the calculating the ratio of the vulnerable pattern (S21) may be changed.

In an exemplary embodiment, the inversion mode determining unit 630 compares the ratio of the vulnerable pattern with a third reference value TH_in_u (S41). In such an embodiment, when the ratio of the vulnerable pattern is greater than the third reference value TH_in_u (YES), the inversion mode determining unit 630 selects one of at least one modified inversion mode such that the selected modified inversion mode is determined as the inversion mode of the corresponding frame (S60). In such an embodiment, when the ratio of the vulnerable pattern is less than or equal to the third reference value TH_in_u (NO), the inversion mode determining unit 630 maintains the reference inversion mode such that the reference inversion mode is determined as the inversion mode of the corresponding frame (S70).

In such an embodiment, an operation where the modified inversion mode is identified as the previous inversion mode (S10), that is, an operation where the previous inversion mode enters the modified inversion mode in advance, is substantially the same as the operation where the inversion mode is identified as the previous inversion mode in FIG. 5, and any repetitive detailed description thereof will hereinafter be omitted.

In an exemplary embodiment, as shown in FIG. 6, the third reference value TH_in_u and the second reference value TH_out_v may be expressed in a unit corresponding to the unit on the ratio of the invulnerable pattern or the ratio of the vulnerable pattern. In one exemplary embodiment, for example, the third reference value TH_in_u and the second reference value TH_out_v may be represented by percentage as a ratio of the invulnerable pattern to the entire screen. In an alternative exemplary embodiment, the third reference value TH_in_u and the second reference value TH_out_v may be represented by various units such as the number of pixels PX, the number of pixel blocks, each of which includes at least two pixels PX, at least one pixel row or at least one pixel column, for example.

In an exemplary embodiment, as shown in FIG. 6, the third reference value TH_in_u and the second reference value TH_out_v may be different from each other. In one exemplary embodiment, for example, when the reference value is represented by percentage, a difference between 100 and the third reference value TH_in_u may be less than the second reference value TH_out_v. In such an embodiment, an effect from a frequent luminance change of the image is substantially reduced, such that a frequency of entry into or escape from the modified inversion mode may be effectively prevented from being substantially high and a deterioration of image quality due to the frequent luminance change may be prevented.

Referring to FIG. 7, another alternative exemplary embodiment of an operation of the signal controller 600 may be performed based on the combination 2 of the combinations shown in FIG. 4. The same or like elements shown in FIG. 7 have been labeled with the same reference characters as used above to describe the exemplary embodiments of the operation of the signal controller shown in FIG. 5, and any repetitive detailed description thereof will hereinafter be omitted or simplified.

In such an embodiment, an operation where the inversion mode of the previous inversion mode (S10) is not identified as the modified inversion mode (NO), that is, an operation where the previous inversion mode is the reference inversion mode, is substantially the same as the operation where the pervious inversion mode is the reference inversion mode in FIG. 5, and any repetitive detailed description thereof will hereinafter be omitted.

In an exemplary embodiment, as shown in FIG. 7, when the previous inversion mode (S10) is identified as the modified inversion mode (YES), that is, when the previous inversion mode enters the modified inversion mode in advance, the pattern ratio detecting unit 620 calculates the ratio of the vulnerable pattern (S31). In an alternative exemplary embodiment, the sequence between the identifying the previous inversion mode (S10) and the calculating the ratio of the vulnerable pattern (S31) may be changed.

In an exemplary embodiment, the inversion mode determining unit 630 compares the ratio of the vulnerable pattern with a fourth reference value TH_out_u (S51). In such an embodiment, when the ratio of the vulnerable pattern is less than the fourth reference value TH_out_u (YES), the inversion mode determining unit 630 maintains the reference inversion mode such that the reference inversion mode is determined as the inversion mode of the corresponding frame (S70). In such an embodiment, when the ratio of the vulnerable pattern is greater than or equal to the fourth reference value TH_out_u (NO), the inversion mode determining unit 630 selects one of at least one modified inversion mode such that the selected modified inversion mode is determined as the inversion mode of the corresponding frame (S60).

In such an embodiment, as shown in FIG. 7, the first reference value TH_in_v and the fourth reference value TH_out_u may be expressed in a unit corresponding to of the unit on the ratio of the invulnerable pattern. In one exemplary embodiment, for example, the first reference value TH_in_v and the fourth reference value TH_out_u may be represented by percentage as a ratio of the invulnerable pattern to the entire screen. In an alternative exemplary embodiment, the first reference value TH_in_v and the fourth reference value TH_out_u may be represented by various units such as the number of pixels PX or the number of pixel blocks, each of which includes at least two pixels PX, at least one pixel row, or at least one pixel column, for example.

In an exemplary embodiment, as shown in FIG. 7, the first reference value TH_in_v and the fourth reference value TH_out_u may be different from each other. In one exemplary embodiment, for example, when the reference value is represented by percentage, the first reference value TH_in_v may be less than a difference between 100 and the fourth reference value TH_out_u. In such an embodiment, an effect from a frequent luminance change of the image is substantially reduced, such that a frequency of entry into or escape from the modified inversion mode may be effectively prevented from being substantially high, and a deterioration of image quality due to the frequent luminance change may be effectively prevented.

In at least one of the comparings S40, S50, S41 and S51 of the ratio of the invulnerable pattern or the ratio of the vulnerable pattern with various reference values in the exemplary embodiments shown in FIGS. 5 to 7, signs of inequality (< and >) may further include a sign of equality (=) to be ≤ or ≥.

In an exemplary embodiment, as described above, a ratio of the invulnerable pattern is used to determine the inversion mode of the corresponding frame when the previous inversion mode is the reference inversion mode or when the previous inversion mode is the modified inversion mode. In such an embodiment, algorithms for defining types of the vulnerable patterns and determining priorities between the types may be omitted such that algorithms or circuits for determining the inversion mode in the signal controller 600 may be substantially simplified. In such an embodiment, the inversion mode may be determined by combining the ratio of the invulnerable pattern with the ratio of the vulnerable pattern such that the signal controller may substantially effectively operate based on the structure and the driving condition of the display device.

Figure 8:
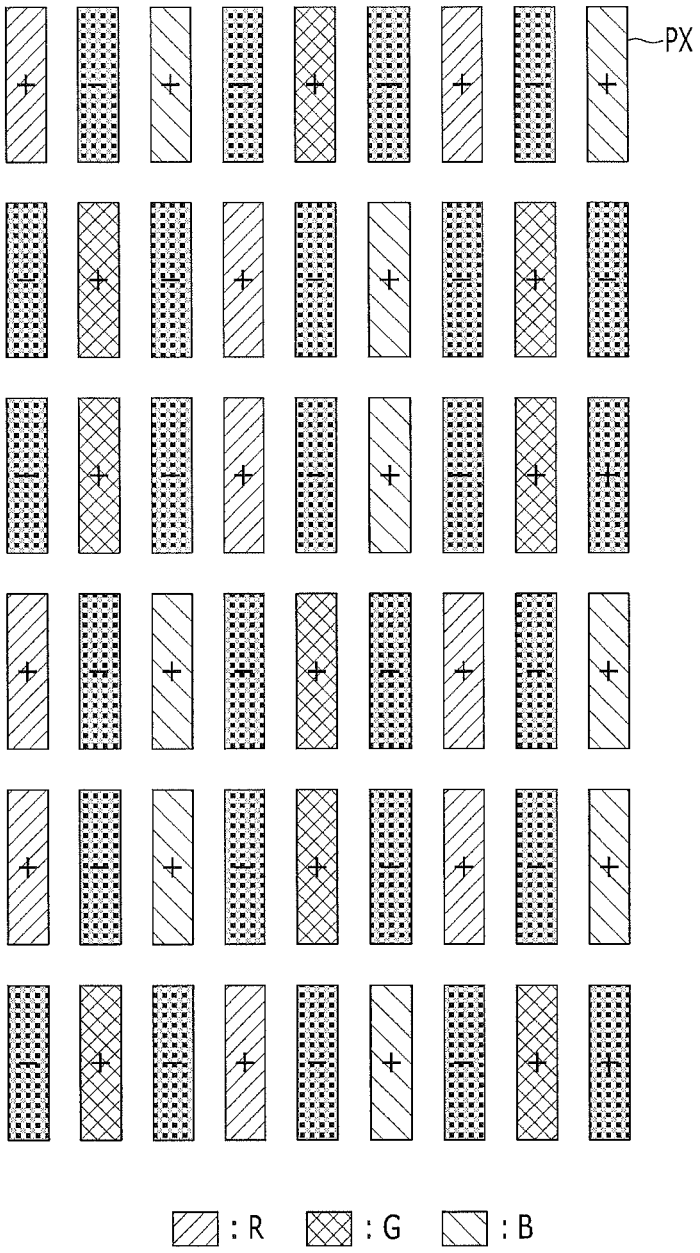
FIG. 8 is a plan view of an exemplary embodiment of a vulnerable pattern displayed by a display device in an inversion mode according to the invention.
Figure 9:
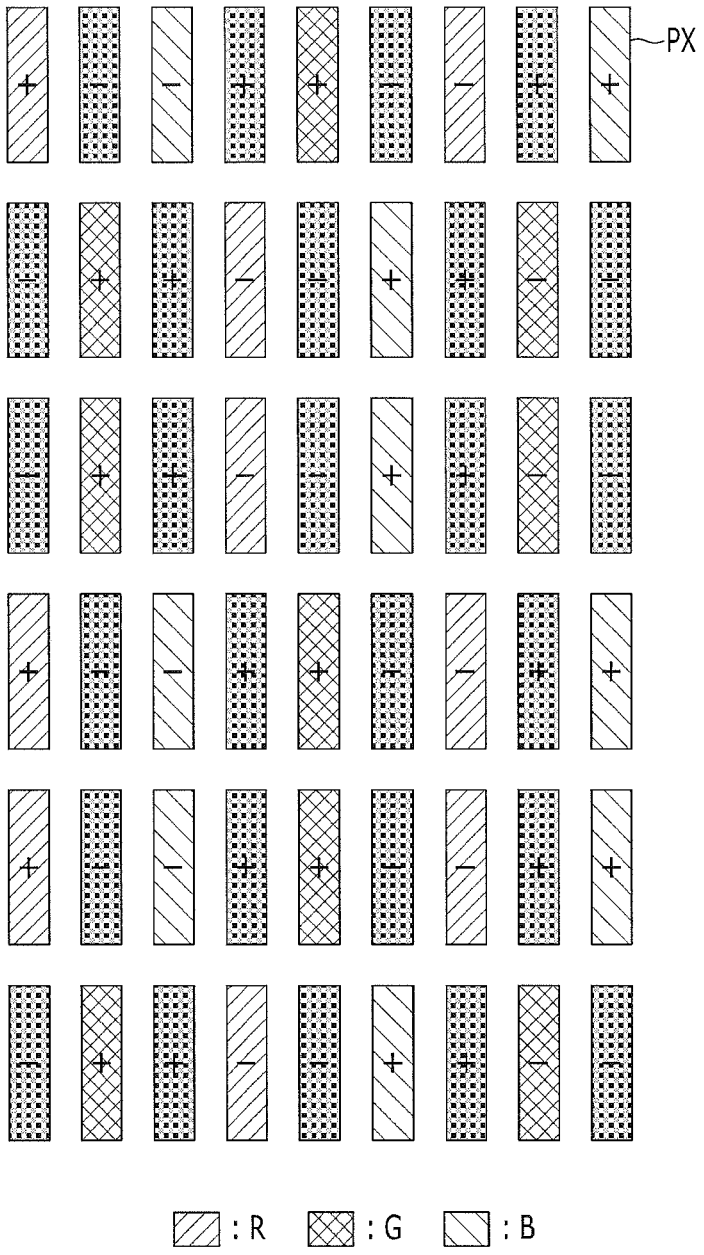
FIG. 9 is a plan view of the vulnerable pattern shown in FIG. 8 displayed by a display device in a modified inversion mode different from the inversion mode shown in FIG. 8.

FIG. 8 is a plan view illustrating an exemplary embodiment of a vulnerable pattern displayed by a display device in an inversion mode according to the invention, and FIG. 9 is a plan view showing the vulnerable pattern shown in FIG. 8 displayed by a display device in a modified inversion mode different from the inversion mode shown in FIG. 8.

FIG. 8 shows an exemplary embodiment where a reference inversion mode is a 2×1 dot inversion driving mode, that is, a horizontally 1 dot and vertically (1+2) dot inversion driving mode. In such an embodiment, when the pattern of the displayed image is a pattern in which all of the pixels PX displaying black have a negative (−) polarity, and all of the pixels PX displaying white have a positive (+) polarity, the corresponding pattern may be the vulnerable pattern for the reference inversion mode.

In such an embodiment, when the corresponding pattern is the vulnerable pattern for the reference inversion mode, the inversion mode may be determined as the modified inversion mode. In an alternative exemplary embodiment, as shown in FIG. 9, an exemplary embodiment of the modified inversion mode may be a 2×2 dot inversion driving mode, that is, a horizontally 2 dot and vertically (1+2) dot inversion driving mode. In such an embodiment, even though the same image pattern as the image shown in FIG. 8 is displayed, the pixels PX having the negative (−) polarity and the pixels PX having the positive (+) polarity are substantially uniformly arranged such that deteriorations of display quality, such as a flicker, for example, are substantially effective prevented.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device, comprising:

a display panel including a plurality of pixels;

a data driver which transmits data voltages to the plurality of pixels; and a signal controller which receives an input image signal and an input control signal, and controls the data driver, wherein the signal controller calculates a ratio of a first type of pattern in an image based on the input image signal, identifies whether a previous inversion mode is a reference inversion mode or a modified inversion mode, uses the ratio of the first type of pattern when the previous inversion mode is the reference inversion mode or when the previous inversion mode is the modified inversion mode, generates a polarity signal based on the ratio of the first type of pattern, and transmits the polarity signal to the data driver.

2. The display device of claim 1, wherein the signal controller comprises:

an inversion mode identifying unit which identifies whether the previous inversion mode is the reference inversion mode or the modified inversion mode, a pattern ratio detecting unit which detects a ratio of the first type of pattern for the reference inversion mode based on the input image signal, and an inversion mode determining unit which determines an inversion mode of a current frame based on the ratio of the first type of pattern.

3. The display device of claim 2, wherein the inversion mode determining unit uses the ratio of the first type of pattern when the previous inversion mode is the reference inversion mode or when the previous inversion mode is the modified inversion mode.

4. The display device of claim 3, wherein the inversion mode determining unit determines the inversion mode of the current frame as the modified inversion mode, when the ratio of the first type of pattern is less than a first reference value, the inversion mode determining unit determines the inversion mode of the current frame as the reference inversion mode, when the ratio of the first type of pattern is greater than or equal to the first reference value and the previous inversion mode is the reference inversion mode, the inversion mode determining unit determines the inversion mode of the current frame as the reference inversion mode, when the ratio of the first type of pattern is greater than a second reference value, and the inversion mode determining unit determines the inversion mode of the current frame as the modified inversion mode, when the ratio of the first type of pattern is less than or equal to the second reference value and the previous inversion mode is the modified inversion mode.

5. The display device of claim 4, wherein the first reference value is less than the second reference value.

6. The display device of claim 3, wherein the pattern ratio detecting unit detects a ratio of a second type of pattern in the image for the reference inversion mode based on the input image signal, the inversion mode determining unit determines the inversion mode of the current frame as the modified inversion mode, when the ratio of the second type of pattern is greater than a third reference value, the inversion mode determining unit determines the inversion mode of the current frame as the reference inversion mode, when the ratio of the second type of pattern is less than or equal to the third reference value and the previous inversion mode is the reference inversion mode, the inversion mode determining unit determines the inversion mode of the current frame as the reference inversion mode, when the ratio of the first type of pattern is greater than a second reference value, and the inversion mode determining unit determines the inversion mode of the current frame as the modified inversion mode, when the ratio of the first type of pattern is less than or equal to the second reference value and the previous inversion mode is the modified inversion mode.

7. The display device of claim 3, wherein the pattern ratio detecting unit detects a ratio of a second type of pattern in the image for the reference inversion mode based on the input image signal, the inversion mode determining unit determines the inversion mode of the current frame as the modified inversion mode, when the ratio of the first type of pattern is less than a first reference value, the inversion mode determining unit determines the inversion mode of the current frame as the reference inversion mode, when the ratio of the first type of pattern is greater than or equal to the first reference value and the previous inversion mode is the reference inversion mode, the inversion mode determining unit determines the inversion mode of the current frame as the reference inversion mode, when the ratio of the second type of pattern is less than a fourth reference value, and the inversion mode determining unit determines the inversion mode of the current frame as the modified inversion mode, when the ratio of the second type of pattern is greater than or equal to the fourth reference value and the previous inversion mode is the modified inversion mode.

8. The display device of claim 3, wherein the ratio of the first type of pattern is represented by one of percentage, the number of pixels and the number of pixel blocks, each of which includes at least one of at least two pixels, at least one pixel row and at least one pixel column.

9. The display device of claim 1, wherein the ratio of the first type of pattern is calculated by determining whether a unit image of the image based on the input image signal corresponds to a second type of pattern, and the unit image is an image displayed by any one of a pixel and a pixel block, wherein the pixel block include one of at least two pixels, at least one pixel row, at least one pixel column and a combination thereof.

10. A driving method of a display device, the method comprising:

calculating a ratio of a first type of pattern in an image based on an input image signal;

identifying whether a previous inversion mode is a reference inversion mode or a modified inversion mode;

using the ratio of the first type of pattern when the previous inversion mode is the reference inversion mode or when the previous inversion mode is the modified inversion mode; and determining an inversion mode of a current frame based on the ratio of the first type of pattern, wherein the display device comprises:

a display panel including a plurality of pixels;

a data driver; and a signal controller which receives the input image signal and an input control signal to control the data driver.

11. The method of a display device of claim 10, further comprising:

identifying whether a previous inversion mode is a reference inversion mode or a modified inversion mode.

12. The driving method of a display device of claim 11, wherein the ratio of the first type of pattern is a ratio of the first type of pattern in the image displayed in the reference inversion mode.

13. The driving method of a display device of claim 12, wherein the calculating the ratio of the first type of pattern in the image comprises:

determining whether a unit image of the image based on the input image signal corresponds to a second type of pattern, and the unit image is an image display by one of a pixel and a pixel block, wherein the pixel block comprises at least two pixels, at least one pixel row, at least one pixel column or a combination thereof.

14. The driving method of a display device of claim 12, wherein the determining the inversion mode of the current frame comprises:

determining the inversion mode of the current frame as the modified inversion mode, when the ratio of the first type of pattern is less than a first reference value;

determining the inversion mode of the current frame as the reference inversion mode, when the ratio of the first type of pattern is greater than or equal to the first reference value and the previous inversion mode is the reference inversion mode;

determining the inversion mode of the current frame as the reference inversion mode, when the ratio of the first type of pattern is greater than a second reference value; and determining the inversion mode of the current frame as the modified inversion mode, when the ratio of the first type of pattern is less than or equal to the second reference value and the previous inversion mode is the modified inversion mode.

15. The driving method of a display device of claim 14, wherein the first reference value is less than the second reference value.

16. The driving method of a display device of claim 12, wherein the calculating the ratio of the first type of pattern further comprises detecting a ratio of a second type of pattern in the image for the reference inversion mode based on the input image signal.

17. The driving method of a display device of claim 16, wherein the determining the inversion mode of the current frame comprises:

determining the inversion mode of the current frame as the modified inversion mode, when the ratio of the second type of pattern is greater than a third reference value;

determining the inversion mode of the current frame as the reference inversion mode, when the ratio of the second type of pattern is less than or equal to the third reference value and the previous inversion mode is the reference inversion mode;

determining the inversion mode of the current frame as the reference inversion mode, when the ratio of the first type of pattern is greater than a second reference value; and determining the inversion mode of the current frame as the modified inversion mode, when the ratio of the first type of pattern is less than or equal to the second reference value and the previous inversion mode is the modified inversion mode.

18. The driving method of a display device of claim 16, wherein the determining the inversion mode of the current frame comprises:

determining the inversion mode of the current frame as the modified inversion mode, when the ratio of the first type of pattern is less than a first reference value;

determining the inversion mode of the current frame as the reference inversion mode, when the ratio of the first type of pattern is greater than or equal to the first reference value and the previous inversion mode is the reference inversion mode;

determining the inversion mode of the current frame as the reference inversion mode, when the ratio of the second type of pattern is less than a fourth reference value; and determining the inversion mode of the current frame as the modified inversion mode, when the ratio of the second type of pattern is greater than or equal to the fourth reference value and the previous inversion mode is the modified inversion mode.

19. The driving method of a display device of claim 10, wherein the ratio of the first type of pattern is represented in a unit, which is one of percentage, a number of pixels and a number of pixel blocks, wherein each of the pixel blocks comprises at least two pixels, at least one pixel row or at least one pixel column.

* * * * *